US008109341B1

(12) United States Patent
Szocs

(10) Patent No.: US 8,109,341 B1
(45) Date of Patent: Feb. 7, 2012

(54) METHOD AND HIGH-CAPACITY APPARATUS FOR PRODUCING FIRE FIGHTING FOAM AND FOAM EXPANDING SPREADING DEVICE

(76) Inventor: Istvan Szocs, Budapest (HU)

( * ) Notice: Subject to any disclaimer, the term of this patent is extended or adjusted under 35 U.S.C. 154(b) by 1251 days.

(21) Appl. No.: 09/687,763

(22) Filed: Oct. 13, 2000

(51) Int. Cl.
*A62C 35/00* (2006.01)

(52) U.S. Cl. ..... 169/9; 239/597; 239/601

(58) Field of Classification Search ..... 169/6, 9; 239/596, 597, 598, 601
See application file for complete search history.

(56) References Cited

U.S. PATENT DOCUMENTS

| | | | | |
|---|---|---|---|---|
| 1,674,427 | A * | 6/1928 | Freygang | 222/5 |
| 2,563,300 | A * | 8/1951 | Aker | 239/547 |
| 3,342,271 | A | 9/1967 | Anthony | |
| 3,727,841 | A * | 4/1973 | Hengesbach | 239/145 |
| 4,291,769 | A | 9/1981 | Muller | |
| 5,409,067 | A * | 4/1995 | Esposito et al. | 169/62 |

FOREIGN PATENT DOCUMENTS

| | | |
|---|---|---|
| EP | 0774278 A2 | 5/1997 |
| WO | WO 95/11725 | 5/1995 |

* cited by examiner

*Primary Examiner* — Christopher Kim
(74) *Attorney, Agent, or Firm* — Kolisch Hartwell, P.C.

(57) ABSTRACT

Method for producing fire fighting foam using a composition is prepared consisting of foaming agent, water and gaseous medium. The composition is prepared via dissolving or emulsifying the components in one another under overpressure, the composition prepared this way is stored under overpressure at the required place for the required period of time, transported if necessary maintaining the overpressure, and it is expanded via decompressing it on the spot and at the time of application. The apparatus for producing the fire fighting foam comprises a high-pressure foam source (10), a foam expanding spreading device (60) and a pressure resistant pipeline (40) connecting the high-pressure foam source (10) with the foam expanding spreading device (60). A foam expanding spreading device comprises an admission opening and a discharge mouth, a tubular distributing body (63) suitably forming a closed loop of tubes, preferably of torus shape, the discharge mouth, suitably a slit (65) or a set of holes, is situated on the nappe of the tube along its length, preferably along its generating line.

3 Claims, 8 Drawing Sheets

Figure 1:
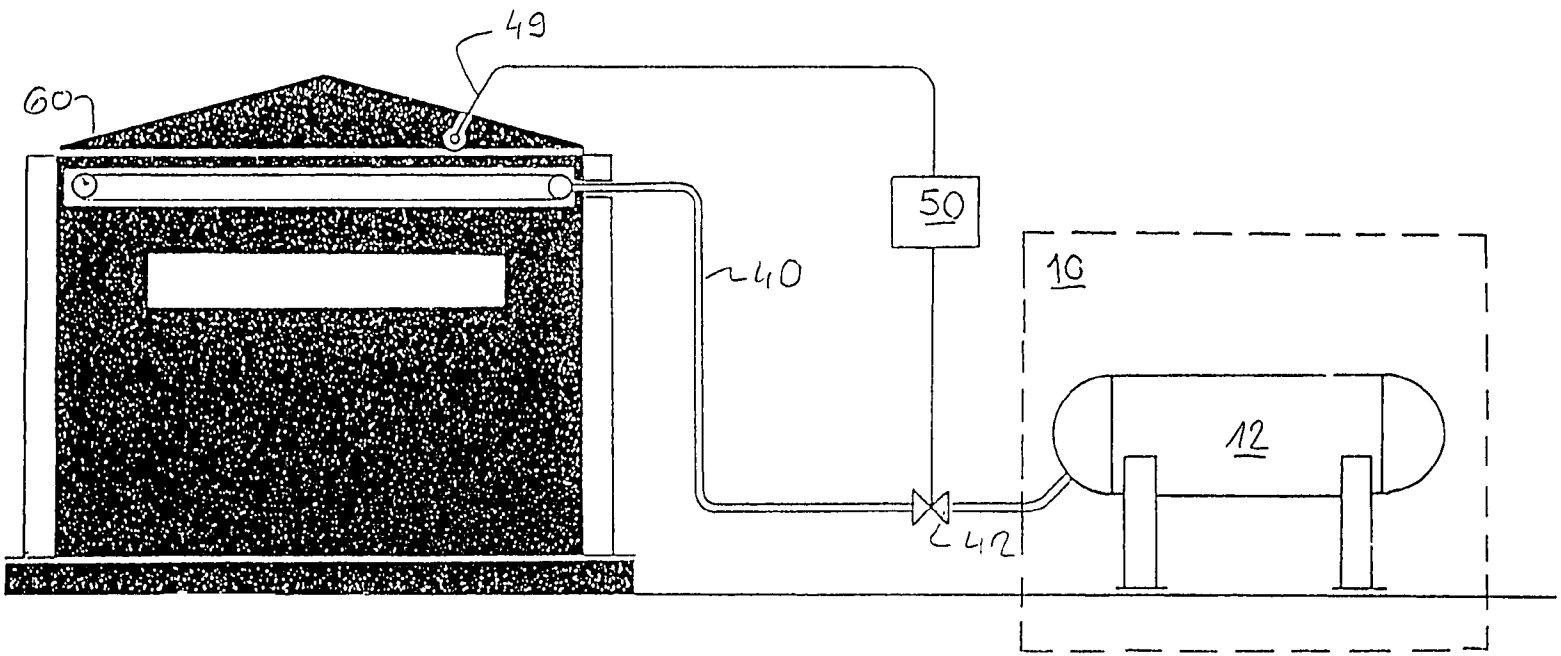

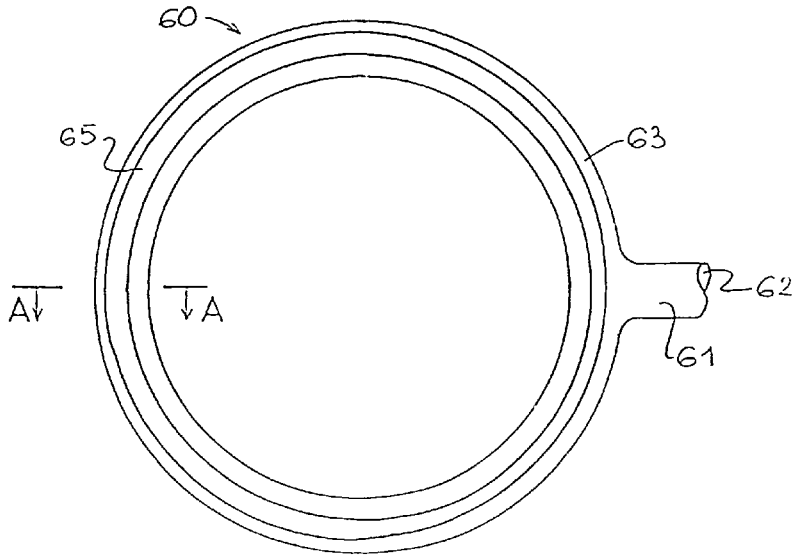
FIG. 4.
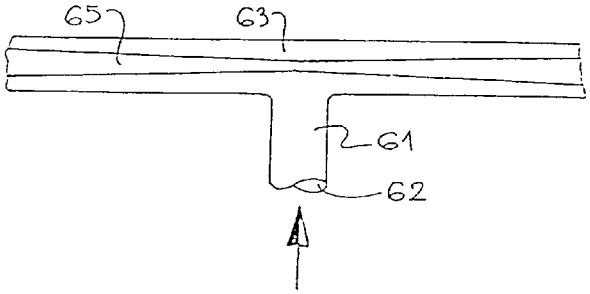
FIG. 5.
FIG. 6.
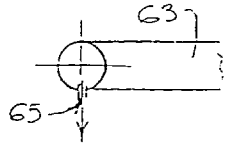
FIG. 7.
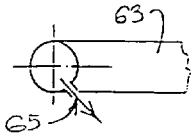

METHOD AND HIGH-CAPACITY APPARATUS FOR PRODUCING FIRE FIGHTING FOAM AND FOAM EXPANDING SPREADING DEVICE

This application is a continuation application under 35 U.S.C. §120 of Intl. Appl. No. PCT/HU/99/00027, having an International Filing Date of Apr. 15, 1999 and designating the United States of America, and which in turn claims the benefit of the filing date of Hungarian Application no. P 98 00877, filed Apr. 15, 1998.

The invention relates to a method and a high-capacity apparatus for producing fire fighting foam and a foam expanding spreading device which method and apparatus able to produce quickly a bulk of fire fighting foam and to discharge the produced fire fighting foam onto a large surface in a layer of uniform thickness, which method and apparatus can particularly be used as fire extinguisher of tanks containing liquid fluids especially liquid hydrocarbons and to extinguish fire thereof.

In course of the method according to the invention a composition is prepared consisting of foaming agent, water and gaseous medium.

It is well-known that air-foams are generally used to extinguish fire of storage tanks containing inflammable liquids, especially liquid hydrocarbons.

It is typical of the known production methods of such fire fighting foams that they are produced on the spot during the process of extinguishing, using means and energy available there at that time. Foaming agent kept on store on the spot or conveyed there by the firemen after the fire has broken out is used for producing the foam, aqueous solution of the foaming agent is produced, and, using appropriate means to increase its pressure, the foaming agent solution is conveyed to the foam-generating head through appropriate pipes. The streaming foaming agent solution is mixed with air in the foam-generating head and it becomes foaming there, the process of foaming uses up the kinetic energy of the solution, and the foam is directed to the place of application.

It is also known that foam fire extinguishing devices used at storage tanks or storage tank farms containing inflammable liquids are fixed or semi-fixed fire extinguishers.

Semi-fixed fire extinguishers comprise pipelines or a pipeline-network conveying the foaming agent solution from the inlet place to the storage tanks, one or several foam-generating heads, foam supply pipeline(s), foam introducing device (s). Separate pumps (firefighting trucks) are necessary to ensure the streaming of the foaming agent solution. The foaming agent used for producing the fire fighting foam is taken to the spot after the fire has broken out, the solution can be prepared and the fire fighting foam can be produced only afterwards.

In addition, fixed fire extinguishers have a solution supply centre, a so called extinguishing centre as well. The extinguishing centre is equipped with a ready-to-use foaming agent storing tank, water supply connection taps to gain water or a water-reservoir of the required capacity, proportioners to mix the foaming agent and pumps to establish the required pressure, and these pumps are connected to the pipeline of the foaming agent solution with appropriate valves inserted.

Both at fixed and semi-fixed fire extinguishers the fire fighting foam is applied to the surface of the liquid in the same way. At solutions where the foam is introduced in the tank at the rim of the tank, e.g. at fire extinguishers presented in patent specifications USP 4.893.681 and USP 4.148.361, there are usually more than one foam introducing places along the circumference of the tank. There are foam introducing appliances with foam chambers or foam boxes situated at the foam introducing places, as described in Swiss patent specification No. 676.553, foam deflectors are used to direct the foam stream to the surface of the liquid or to the inner wall of the tank. If the distance between the foam deflectors and the surface of the liquid is larger than a given maximum value, foam sliders equipped with guide- and damping-plates are used to direct the foam to the surface of the liquid and to reduce the velocity of the foam flowing out.

Further, there are solutions with devices to let the fire fighting foam under the surface of the liquid in the tank or right to the surface of the liquid at some given places, an example for the former one is described in patent specifications USP 4.664.199, USP 5.377.765 and USP 5.464.065, an example for the latter is presented in patent specification USP 5.573.068.

The above described solution, where the fire fighting foam is produced when used on the spot, that is, at the place and at the time of fighting the fire, has several disadvantages as regards both the method and the fire extinguisher apparatuses.

The most important disadvantage is that there is a long period of time between the inflammation and the begin of extinction of the fire. Usually it takes about 10 minutes to 2-3 hours from the detection of the fire till starting to extinguish it to complete the fire extinguisher system, produce the foaming agent solution and then the fire fighting foam from the foaming agent available on the spot or taken to the spot just that time, and to fill and activate the system to start producing the foam. Further, after the extinguishing of the fire has been started, it also takes significant time to produce enough foam to form a foam blanket of the required thickness and to spread this amount of foam in uniform thickness on the surface of the burning liquid. During this time the damage caused by the fire is permanently increasing regarding both the material destroyed and the growing damage done to the otherwise valuable tank, while the environment is also being permanently polluted. In order to indicate the magnitude of the damage and its being proportional with time, we present an example. The surface of a tank of 30000 $m^3$ is about 2000 $m^2$, the burning-rate constant of petrol is 7 mm/min, so approximately 14 $m^3$ petrol is burnt in the fire every minute. In addition to the loss caused by the destruction of such an amount of petrol, the released heat also endangers the surrounding establishments, and if it is a tank farm, the other tanks are also considerably endangered.

It is a further important disadvantage that the reliability of the process of foam production is low, as foam production may be reduced or made impossible by a possible gag of the narrow flow cross section of the nozzle of the foam generating injector due to contamination with dust or dirt, or by tapering of the air inhausting holes, e.g. getting obstructed with tree-leaves. It is a further disadvantage that foam-volume flow and foam intensity is limited. The basic reason of this limit is that the foam is generated via using up the kinetic energy of the foaming agent. Nearly the entire pressure causing the solution to flow drops at the foam generating head, the pressure of the foam ejected from the foam generating head is close to the atmospheric pressure, and it drops to the atmospheric pressure in the foam supply pipeline, hence the limit of foam production is determined by the upper limit of the transporting capacity of the device generating the flow of the solution, e.g. the capacity of the pump. A further limit is set by the narrow cross section of the nozzle used for foam production. A further disadvantage of the method is the varying quality of the foam, as the quality of the fire fighting foam produced as described above is varying depending on the actual flow conditions, reducing the effectiveness of extinguishing the fire.

As regards fixed extinguishers, where all the components necessary for producing the fire fighting foam are available and all the equipment is stored in a ready-to-use status on the site of the possible fire, near the storage tank of the inflammable liquid, usually at the edge of the tank farm, it is a further disadvantage that the foaming agent solution is started to be produced when it is used, and it is produced until the fire is safely extinguished. Not only the price of the installation of such a fixed fire extinguisher is quite high, but the required bulk of foaming agent to be stored on the spot requires significant investment as well.

As regards semi-fixed fire extinguishers, it is a further disadvantage that as it is only the pipeline-network conveying the foaming agent solution, the foam generating heads, the foam supply pipelines and the foam introducing devices that are settled on the spot, and in case of fire, the foaming agent concentrate or the foaming agent solution is taken to the spot with a transport vehicle, it is mixed with water on the spot using the instruments of the transport vehicle, and it is pumped into the settled pipeline network with pumps ensuring the required pressure, the extinguishing of the fire can be started only with significant delay, and in certain cases the time lost can not be regained.

A further disadvantage of the above described fire extinguishers in connection with the former problems is that the foam let to the surface is uneven. The known method of letting the foam to the surface at certain places along the circumference of the tank or discharging the foam from the foam box does not form a foam blanket of uniform thickness, and it takes long time till the foam emitted forms a foam blanket entirely covering the surface of the liquid. The part of the surface not covered with foam keeps burning during this long time and the foam may be spoiled at the edge of the foam blanket, therefore the process of extinguishing drags out.

It is a further disadvantage that, as the foam produced in the foam generating head and conveyed through the foam supply pipelines is used immediately after leaving the foam supply pipeline, and it is used up when being applied, it is practically impossible to reduce the unsteadiness of foam generation or to modify the quality of the foam during operation, considering that usually there is a surface burning with high flames where the foam is emitted. Hence the quality of the foam produced and used when extinguishing the fire is determined by the parameters specified in advance and the actual conditions of foam generation, and it is not always the optimum for the given fire.

The major disadvantages of the above described solutions—the set-up time before starting extinguishing, the unsteadiness of foam generation, the fact that the foam is generated via using up the kinetic energy of the flowing solution, the resulting limited intensity of the foam, the incalculable quality of foam and the slow spreading of the foam—made it necessary to seek for a solution where the foam, that is otherwise suitable for fighting fire, can be produced and directed to the place of application without the disadvantages listed above.

The fundamental idea of the invention is that the disadvantages described above can be attributed to the simultaneity of generating and applying the foam. The basic idea of the invention is that if the production and application of the fire fighting foam is divided into two separate actions, that is, if the generation and the conveyance of the fire fighting foam is separated in a way that the generation of the foam is independent from its flowing, and we store the energy necessary for the conveyance of the foam together with the essentially ready foam in the form of pressure energy, all these make it possible to produce foam of uniform quality that can be better influenced than in case of the known methods, and to adjust the quantity emitted, which makes the extinction of the fire quick and economical. It is a further discovery that we can store the fire fighting foam produced with the method in a device that is connected to the known foam conveying and foam emitting devices, forming this way a fixed fire extinguisher that is able to supply fire fighting foam immediately in case of fire.

A further discovery leading to the invention was that foam can be emitted in a smooth manner within a short time with a device where the foam is emitted not at a single point, but along a longer section, preferably along the circumference of the surface of the liquid or the side-wall of the tank etc. at the same time, the device being able to emit the same amount and quality of foam at any point of emission along the section.

In course of the fire fighting foam production method according to the invention, which is a solution for the problem, a composition is prepared consisting of foaming agent, water and gaseous medium. The essence of the method is that the composition is prepared via dissolving or emulsifying the components in one another under overpressure, the composition prepared this way is stored under overpressure at the required place for the required period of time, transported if necessary while the overpressure is maintained, and it is expanded via decompressing it on the spot and at the time of application.

In course of implementing the method of the invention the water-soluble gaseous medium can preferably be carbon-dioxide. For solving the gaseous medium, the overpressure is chosen to be at least 10 bar, preferably more than 15 bar. Dissolution is made at room temperature. It is quite advantageous to complete the solution in a way that liquid carbon-dioxide is absorbed in water. If water-insoluble gases, e.g. halogenated hydrocarbons are used, the gaseous medium is to be dispersed in the foaming agent or the aqueous solution thereof at a pressure of 10-40 bar, preferably above 16 bar. In order to make dispersion more uniform, known emulsifying agents indifferent against the foaming agent can be used.

The ready-to-use fire fighting foam is generated when the composition is released to the atmospheric pressure, by expansion of the gaseous medium dissolved or dispersed in the composition, via certain inflation of the generated bubbles as a result of the decrease of overpressure. As the final step of foam production, the composition under overpressure is let out to atmospheric pressure preferably at the place of application, above or below the burning surface of the liquid, therefore the fire fighting foam is immediately used on the spot when it takes its final form, and the apparatus producing the foam can be considered as a fixed fire extinguisher.

The essence of the apparatus suitable for producing fire fighting foam being a solution for the problem is that it comprises a high-pressure foam source, a foam expanding spreading device and a pressure resistant pipeline connecting the high-pressure foam source with the foam expanding spreading device.

A preferable, automatic embodiment of the apparatus comprises a valve inserted in the pressure resistant pipeline, preferably a remote controlled valve.

The embodiments of the apparatus of the invention can be built up to different extent, depending on the demand.

It is an advantageous embodiment where the high-pressure foam source of the apparatus has a high-pressure tank containing the composition, and the pressure resistant pipeline is connected to the opening of the tank with a main valve inserted.

If greater extent of foam is to be produced, it is an advantageous embodiment where the high-pressure foam source of the apparatus comprises a high-pressure tank containing water with foam generating gas absorbed in it, a foaming agent container and a mixer, the (pressure resistant) high-pressure tank is connected to one inlet of the mixer with a stop-valve inserted, and the foaming agent container is connected to the other inlet of the mixer, while the discharge mouth of the mixer is connected to the pressure resistant pipeline directly or with a second valve inserted.

If very great extent of foam is to be produced, e.g. to be used at a tank farm, it is an advantageous embodiment where the high-pressure foam source of the apparatus comprises an absorbing vessel and a liquid or gaseous foam generating gas container connected to one inlet of the absorbing vessel directly or with a pressure controller inserted, a mixer with a foaming agent container connected to one of its inlets, the other inlet of the absorbing vessel is fashioned in a way that it can be connected to a water supply, the outlet of the absorbing vessel is connected to the other inlet of the mixer, and the outlet of the mixer is connected to the pressure resistant pipeline.

At an other advantageous embodiment to be used if very great extent of foam is to be produced, e.g. at a tank farm, the high-pressure foam source of the apparatus comprises an absorbing vessel and a liquid or gaseous foam generating gas container connected to one inlet of the absorbing vessel directly or with a pressure controller inserted, a mixer with a foaming agent container connected to one of its inlets, the other inlet of the mixer is fashioned in a way that it can be connected to a water supply, the outlet of the mixer is connected to the other inlet of the absorbing vessel, and the outlet of the absorbing vessel is connected to the pressure resistant pipeline.

If the apparatus is used at a tank farm, the pressure resistant pipeline of the apparatus branches and a disconnecting valve is inserted in each branch of the pipeline.

Another a subject of the invention is a foam expanding spreading device to be used for discharging fire fighting foam onto a large surface in a layer of uniform thickness. The essence of the first embodiment of the device to be primarily used at applications of lower output demand is, that it comprises an admission opening and a discharge mouth, a tubular distributing body suitably forming a closed loop of tubes, preferably of torus shape, the discharge mouth, suitably a slit or a set of holes, is situated on the nappe of the tube along its length, preferably along its generating line. If the device is a longer one, it is an advantageous embodiment where the discharge mouth, suitably a slit or a set of holes, is formed in a way that its size per unit length of the tube is growing according to the distance from the admission opening.

The essence of the second embodiment of the foam expanding spreading device to be used for discharging fire fighting foam onto a large surface in a layer of uniform thickness, to be primarily used at applications of higher output demand, is that it comprises an admission opening and a discharge mouth, a tubular distributing body suitably forming a closed loop of tubes, preferably of torus shape, a suitably tubular high-pressure receiving chamber preferably forming a closed loop of tubes, preferably of torus shape, mostly arranged in a way that the torus shaped distributing body is concentrically surrounded by the torus shaped high-pressure receiving chamber, the distributing body is connected to the high-pressure receiving chamber with hydraulically balanced feeding, and the discharge mouth, suitably a slit or a set of holes, is situated on the nappe of the tubular distributing body along its length, preferably along its generating line, and the admission opening is the admission opening of the high-pressure receiving chamber.

The main advantage of the method according to the invention is that the fire fighting foam is generated when the composition of the foaming substance is released from the apparatus to the space of atmospheric pressure by expansion of the compressed gaseous medium in the composition, therefore the foam of the required quality is surely produced. It is a further advantage that the risk of failure is very low as there is no nozzle-like narrowing in the pipelines. The tanks storing the composition with the gaseous medium absorbed in it are pressurised energy-storing devices, hence their operation usually does not depend on external factors, e.g. intermission of electric supply etc, and the set-up time before starting extinguishing is negligible.

At apparatuses storing small amount of composition (50-100 $m^3$) containing compressed gaseous medium absorbed in it, successful extinction of the fire is ensured even in total lack of fire water system.

A further significant advantage of the method and apparatus of the invention is that it is suitable for realising very high foam intensity. If we want to empty a tank filled with the required quantity of composition of 16, 25 or 40 bar operational pressure during a pre-determined period of time, knowing the length of the foam supply pipeline we can determine the required diameter of the pipeline. For example it takes 3 minutes to empty an experimental tank filled with 50 kg composition from 14 bar to atmospheric pressure through a 2" pipeline of 4 meter length, the time of extinguishing is approximately the same, and the foam blanket laid on the approximately 10 $m^2$ surface of the liquid is 10 cm thick, resulting in successful extinction of the fire.

A further advantage of the method and apparatus according to the invention is that it supplies foam of uniform quality. As the ratio of all the components of the foam is adjusted when completing the composition in advance, the ratio of the volume of the bubbles and the quantity of the foaming agent solution, that is, the spreading rate of the foam is no longer dependent on external parameters. It also implies the possibility that in course of its operation an apparatus can continuously supply foam of quality chosen as optimal for the given application.

It is an extra advantage of the foam expanding spreading device of the invention that it is suitably situated around the surface of the liquid, and in course of its operation the foam emitted is ring-shaped, and this ring is closing more and more while extinguishing the fire, and finally covers the entire surface of the liquid. It is a further extra advantage of the foam expanding spreading device of the invention that it is suitable for letting the foam either to the surface or under the surface of the liquid.

Figure 2:
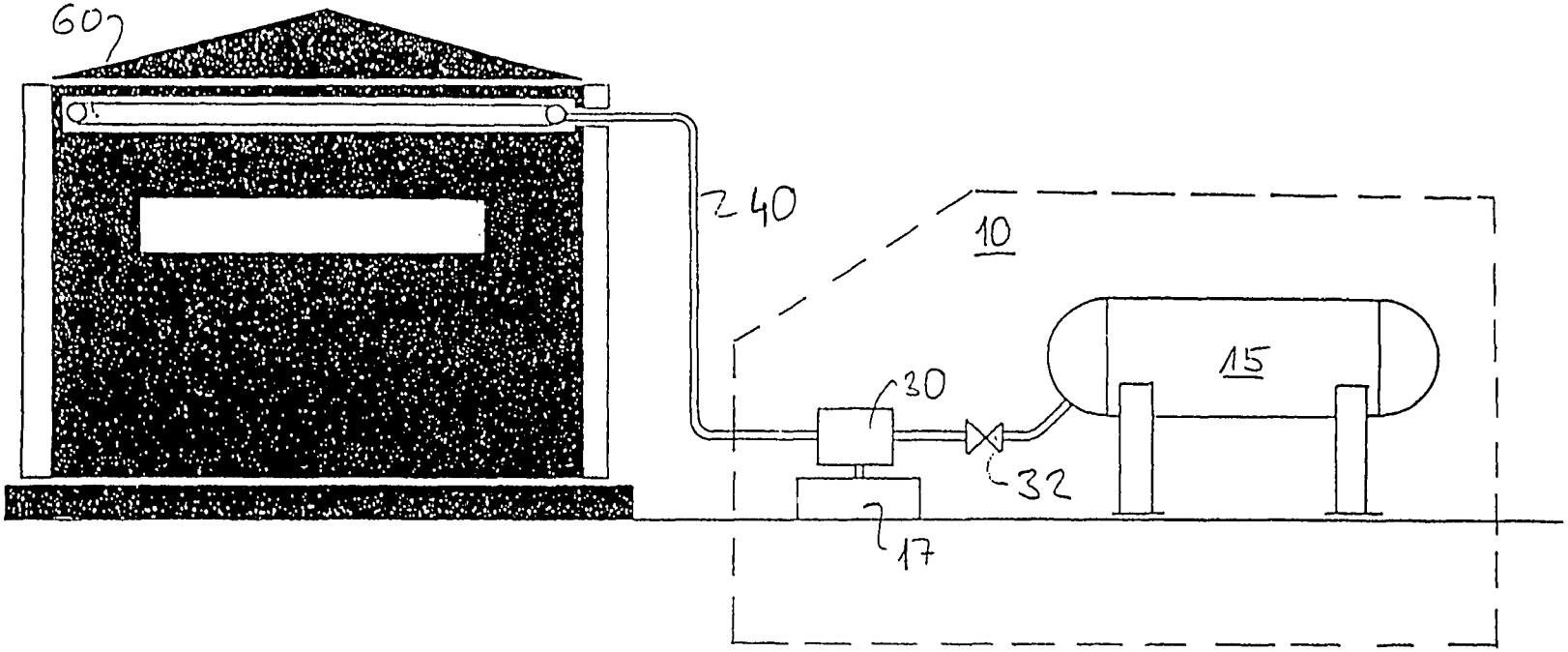
Figure 3:
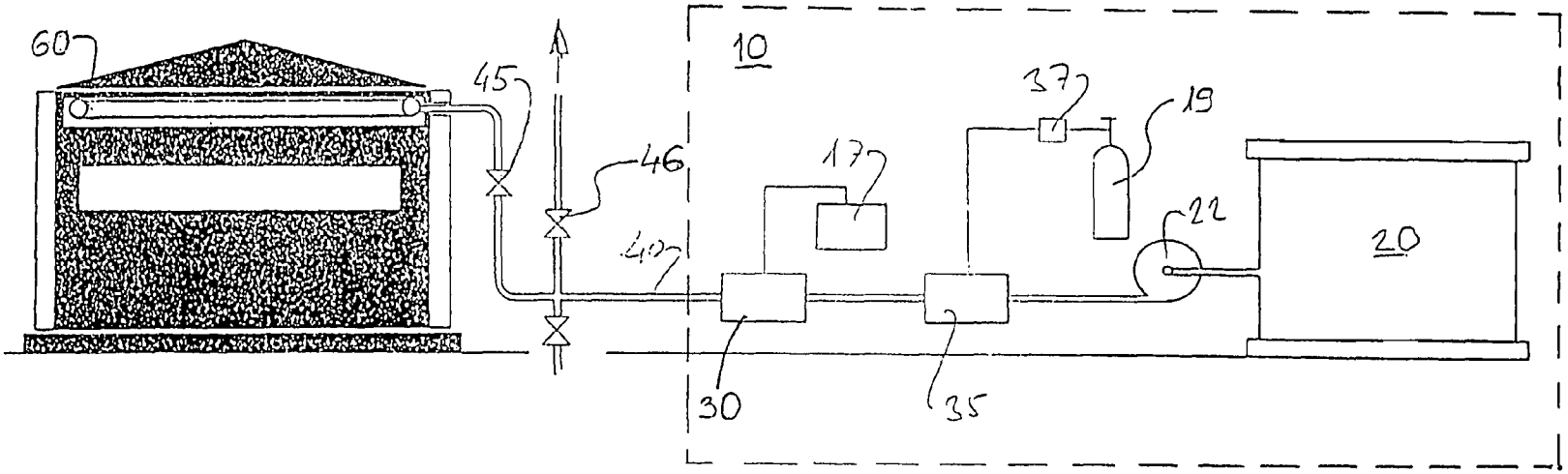
Figure 8:
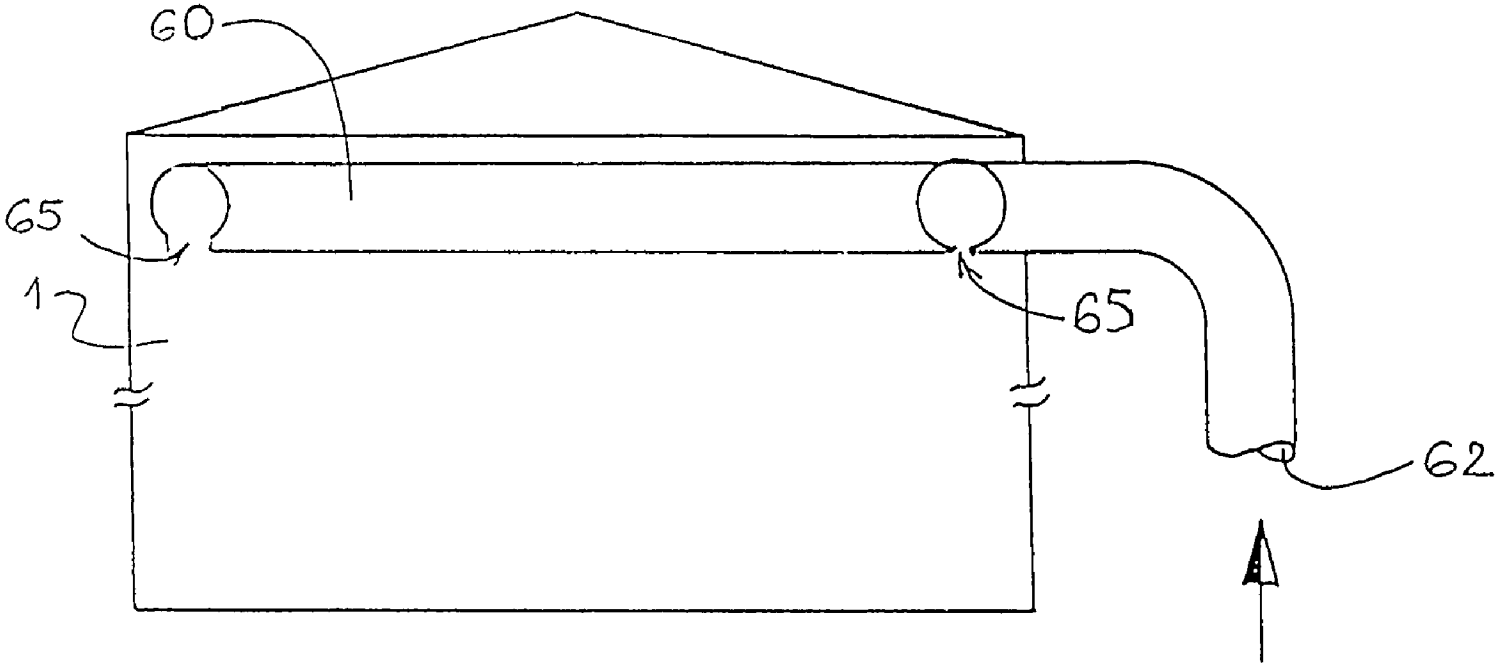
Figure 9:
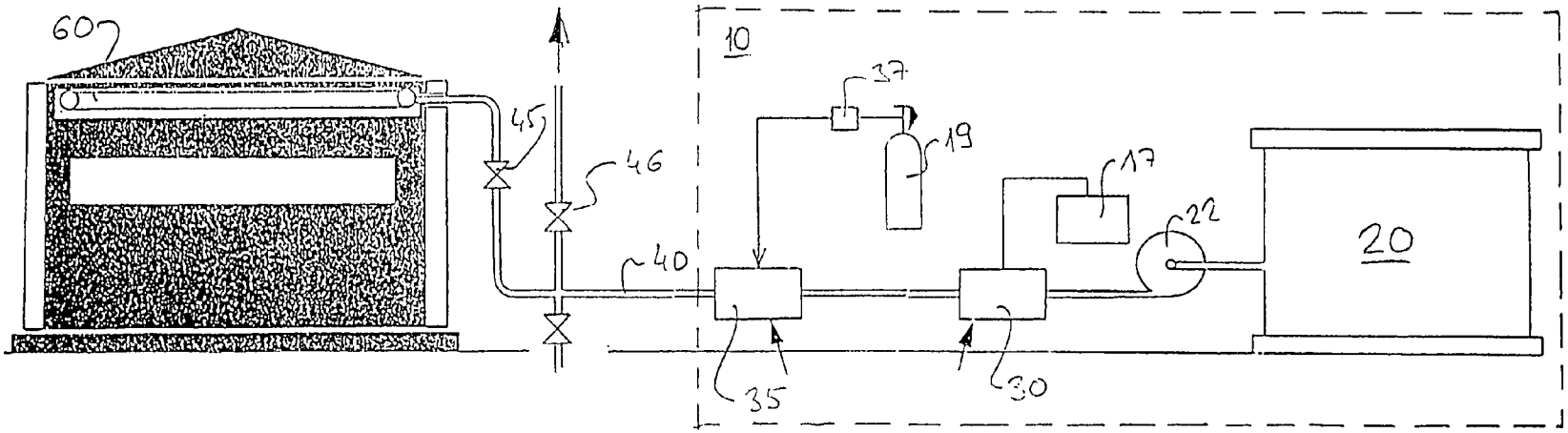
Figure 10:
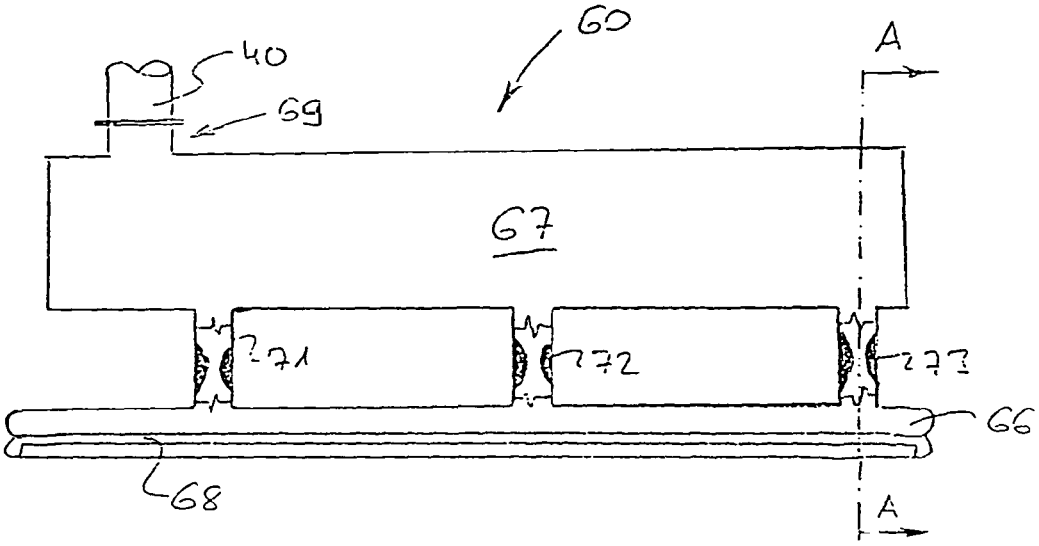
Figure 11:
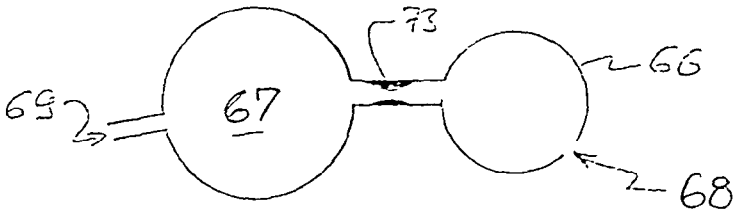
Figure 12:
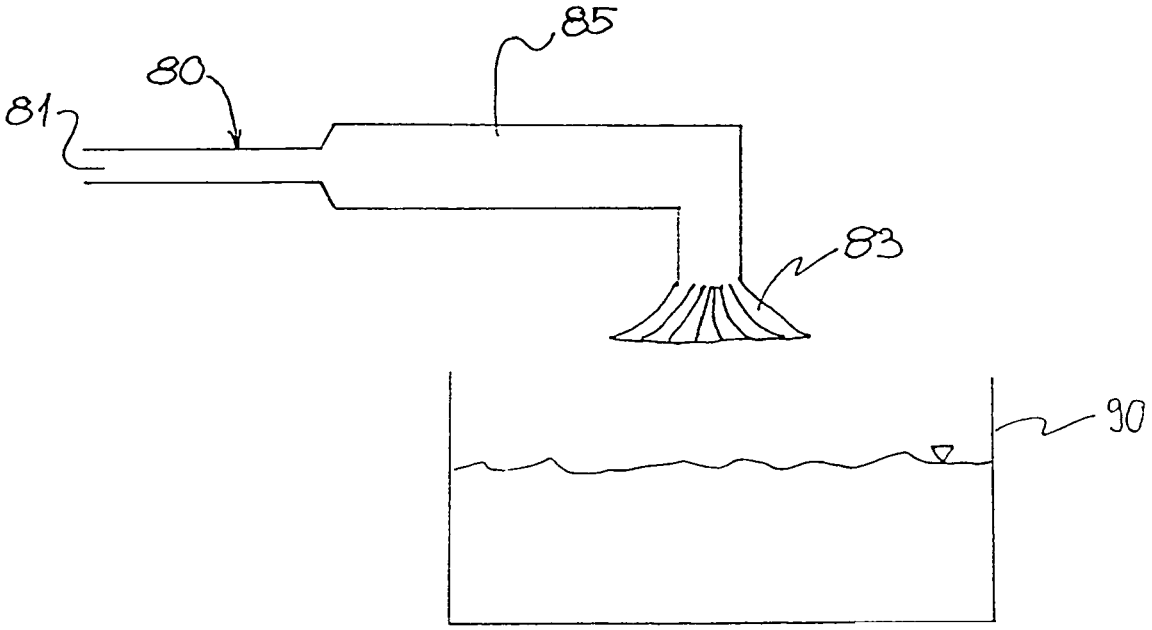

The essence of the invention is now described in detail in connection with preferable embodiments with reference to the accompanying drawings in which:

FIG. 1 is the sketch of the first embodiment of the fire fighting foam producing and fire extinguishing apparatus according to the invention installed at a tank, FIG. 2 is the sketch of the second embodiment of the apparatus according to the invention installed at a tank, FIG. 3 is the sketch of a the third embodiment of the apparatus according to the invention installed at a tank, FIG. 4 is a sketch of an advantageous embodiment of the foam expanding spreading device constituting a further object of the invention, FIG. 5 shows the varying dimension of the slit acting as the discharge mouth of the foam expanding spreading device shown in FIG. 4, via "straightening" the device, FIG. 6 shows the foam expanding spreading device shown in FIG. 4, in section along the A-A plane indicated there, FIG. 7 shows another foam expanding spreading device in similar section as indicated in FIG. 4, FIG. 8 is a lateral view and section of the foam expanding spreading device shown in FIG. 4 installed in a tank, FIG. 9 is the sketch of a further advantageous embodiment of the apparatus, FIG. 10 is the view of the second embodiment of the foam expanding spreading device according to the invention, FIG. 11 shows the section of the foam expanding spreading device shown in FIG. 10, FIG. 12 is the view of the third embodiment of the foam expanding spreading device according to the invention.

The apparatus shown in FIG. 1 comprises a pressure resistant tank (12), there is a pipe stub established on the tank (12), (not indicated in the figure) so as to introduce water, foaming agent and gaseous medium. A circulating pump can be connected to the appropriate pipe stubs of the tank (12) in a detachable way, which can be used for dispersing the components under pressure in the tank (12).

The tank (12) is an installed tank, a pressure resistant pipeline (40) is connected to its outlet, and a remote controlled main valve (42) is inserted in the pipeline (40). The valve (42) may be controlled by the sensor (49) situated in the storage tank with the help of an appropriate control unit (50). The end of the pipeline (40) is protruding into the inner space of the storage tank (1) containing the inflammable liquid, where it is connected to the foam expanding spreading device (60) situated inside the tank (1) above the surface of the liquid along the nappe of the tank (1).

In course of the operation of the apparatus the compressed foaming composition consisting of the foaming agent, water and the propellant gas is prepared in the tank (12) or the composition already prepared is filled in the tank (12). If necessary the mixing of the composition can be promoted using a mechanic mixer and the circulating pump. The composition is stored in this status until being used. When using the apparatus the foaming composition is let into the foam expanding spreading device (60) through the pipeline (40) by opening the valve (42), and the foaming composition is expanding when leaving the device. The expanded foaming composition is the ready-to-use fire fighting foam itself, which is immediately let to the place of application.

The apparatus shown in FIG. 2 comprises a high-pressure tank (15) containing the foam generating gas absorbed in water, a foaming agent container (17) and a mixer (30). Water and gaseous medium is let into the tank (15) mixed or separately through an appropriate pipe stub, and mixing can be promoted using a mechanic mixer and a circulating pump. The outlet of the tank (15) is connected to one inlet of the proportional mixer (30) with a stop-valve (32) inserted, and the foaming agent container (17) is connected to the other inlet of the mixer. The outlet of the mixer (30) is connected to the foam expanding spreading device (60) by the pressure resistant pipeline (40).

In course of the operation of the apparatus water with propellant gas absorbed in it is completed in the tank (15), and it is mixed with the foaming agent concentrate with the help of the mixer (30) when the apparatus is used.

This three-component composition containing the propellant gas absorbed in it is let through the pipeline (40) and the ready fire fighting foam is generated via its expansion as described above.

The apparatus shown in FIG. 3 comprises a water tank (20) connected to one inlet of the absorbing vessel (35) with a booster pump (22) inserted. The outlet of a gas container (19) is connected to the other inlet of the absorbing vessel (35) with a pressure controller (37) inserted. The outlet of the absorbing vessel (35) is connected to one of the inlets of a mixer (30), while the outlet of a foaming agent container (17) is connected to the other inlet of the mixer (30). The outlet of the mixer (30) is connected to pressure resistant pipelines (40) leading to storage tanks containing inflammable liquids, where it is connected to foam expanding spreading device s, of which the figure shows only the foam expanding spreading device (60) situated in the tank (1). The pipeline (40) branches and a disconnecting valve (45, 46) is inserted in each branch of the pipeline.

In course of the operation of the apparatus water stored in the tank (20) is enriched with propellant gas stored in the container (19) in the absorbing vessel (35) and foaming agent concentrate is mixed to this compound in the mixer (30). The three-component composition discharged from the mixer (30) is conveyed to the tank selected (e.g. 1) through the pipeline (40), through its branch determined by the open disconnecting valve (45, 46) of the pipeline (40), and the fire fighting foam is generated there via its expansion as described below.

FIG. 4 shows an advantageous embodiment of the foam expanding spreading device (60) constituting a further object of the invention. The foam expanding spreading device (60) is a tubular equipment forming a kind of ring adjusted to the shape of the storage tank to be protected, fitting close to the inner surface of the sidewall of the tank under the rim of it, and an admission opening (62) is formed on the branch neck (61) of the foam expanding spreading device (60).

The discharge mouth on the tubular body (63) of the foam expanding spreading device (60) is formed as a slit (65) parallel to the axis of the tube in a way that the distance between the edges of the slit (65) is growing according to the distance from the admission opening (62). The growing size of the slit is better seen in FIG. 5, where a part of the foam expanding spreading device (60) is shown "straightened" for better understanding. The cross section of the admission opening (62) and the slit (65) is conveniently the same.

FIG. 6 shows the foam expanding spreading device (60) in section along the A-A plane indicated in FIG. 4, the arrow shows the direction of outflow of the foam. The foam expanding spreading device producing a vertically downwards directed foam-fall can be suitably used in floating roof tanks, the foam flow is directed in the slit between the floating roof and the sidewall of the tank. At the solution shown in FIG. 7 the slit of the device is situated so as to produce foam-fall directed partly downwards and partly sideways, and it is particularly advantageous to apply it at tanks with open liquid surface.

In course of operation the foam flowing in through the admission opening (62) is released through the slit (65). The size of the slit (65) is growing according to the distance from the admission opening (62), so the amount of foam released at sections of the slit farther away from the admission opening (62) is the same as the amount of foam released at sections closer to the admission opening (62), as the pressure of the foam at sections of the slit closer to the admission opening is higher. Accordingly, it can be attained that the foam blanket released is of uniform thickness all along the slit (65). If it is a cylindrical tank, the surface of the liquid is covered in a concentric manner, therefore the surface is entirely covered within a short time.

FIG. 8 shows the foam expanding spreading device (60) installed in a tank (1), the dimensions in the figure are not in proper proportion. The position of the admission opening (62) can be clearly seen in the figure, and it is also clearly seen that the slit (65) acting as a discharge mouth is narrower at its end closer to the admission opening (62), and it is wider at its other end farther from the admission opening (62).

FIG. 9 shows a further embodiment of the apparatus according to the invention, where the water tank (20) is connected to one inlet of the proportional mixer (30) with a pump (22) inserted, and a foaming agent container (17) is connected to the other inlet of the proportional mixer (30). The outlet of the proportional mixer (30) is connected to one inlet of an absorbing vessel (35), and a foam generating gas container (19) is connected to the other inlet of the absorbing vessel (35) with a pressure controller (37) inserted. The outlet of the absorbing vessel (35) is connected to the high-pressure pipeline (40) which branches at this example as well, and disconnecting valves (45, 46) are inserted in each branch. In course of the operation of the apparatus a solution is made from the foaming agent using the proportional mixer (30), and then the foam generating gas is absorbed in this solution. The completed composition appears at the outlet of the absorbing vessel (35) and gets into the pipeline (40) in a ready-to-use form.

The foam expanding spreading device (60) shown in FIG. 10 comprises a high-pressure receiving chamber (67) and a tubular distributing body (66). The chamber (67) is connected to the tubular body (66) with hydraulically balanced feeding, at this embodiment it is attained via connecting members (71, 72 and 73) of choking effect between the chamber (67) and the distributing body (66), the chokes in the connecting members (71, 72 and 73) are shown in the figure in broken-out section of the connecting members (71, 72 and 73). A slit (68) acting as a discharge mouth is made along the generating line of the essentially tubular distributing body (66), while the high-pressure receiving chamber (67) is connected to the pipeline (40) at the admission opening (69) of the chamber (67).

FIG. 11 shows the foam expanding spreading device (60) shown in FIG. 10, in section along the A-A plane indicated there. The high pressure receiving chamber (67) and the distributing body (66) connected to it by the connecting member (73) of choking effect is clearly seen in the figure as well as the foam discharging slit (68) of the distributing body (66) along its generating line.

In course of the operation of the foam expanding spreading device (60) the pressure drops at the members of choking effect, so it is the ready fire fighting foam that gets into the inner space of the distributing body (66). The longitudinal position of the distributing body (66) and the slit (68) ensures that the fire fighting foam is let to the place of application in the form of a blanket.

The invention claimed is:

1. A fixed apparatus for producing fire fighting foam characterised in that it comprises a high-pressure foam source (10), a foam expanding spreading device (60) and a pressure resistant pipeline (40) connecting the high-pressure foam source (10) with the foam expanding spreading device (60), the pipeline having a reversible valve (42) inserted in the pressure resistant pipeline of the apparatus; characterised in that the high-pressure foam source (10) has a high-pressure tank (12) containing a foaming composition, and the pressure resistant pipeline (40) is connected to the opening of the tank (12) with the valve (42) inserted; where the foaming composition includes water, a propellant gas absorbed in the water, and a foaming agent.

2. A fixed apparatus for producing fire fighting foam characterised in that it comprises a high-pressure foam source (10), a foam expanding spreading device (60) and a pressure resistant pipeline (40) connecting the high-pressure foam source (10) with the foam expanding spreading device (60), the pipeline having a reversible valve (42) inserted in the pressure resistant pipeline of the apparatus;

wherein the foam expanding spreading device is characterized in that it comprises an admission opening and a discharge mouth, a tubular distributing body (63) suitably forming a closed loop of tubes, wherein the discharge mouth is situated on a nappe of the tubular distributing body along its length, for discharging fire fighting foam onto a large surface;

wherein the discharge mouth is characterised in that the discharge mouth is formed in a way that the size of the discharge mouth within a selected segment of the tubular distributing body increases with the distance from the admission opening (62) to the selected segment.

3. A fixed apparatus for producing fire fighting foam characterised in that it comprises a high-pressure foam source (10), a foam expanding spreading device (60) and a pressure resistant pipeline (40) connecting the high-pressure foam source (10) with the foam expanding spreading device (60), the pipeline having a reversible valve (42) inserted in the pressure resistant pipeline of the apparatus; characterised in that the reversible valve is a remote controlled valve (42).

* * * * *